US006059283A

United States Patent [19]

Yoneda

[11] Patent Number: 6,059,283

[45] Date of Patent: May 9, 2000

[54] FOLD SECTION FEEDING OUT APPARATUS OF FOLDING UNIT

[75] Inventor: Shuji Yoneda, Kanagawa, Japan

[73] Assignee: Kabushiki Kaisha Tokyo Kikai Seisakusho, Tokyo, Japan

[21] Appl. No.: 09/119,751

[22] Filed: Jul. 21, 1998

[30] Foreign Application Priority Data

Oct. 6, 1997 [JP] Japan ..... 9-272303

[51] Int. Cl.[7] ..... B65H 29/00

[52] U.S. Cl. ..... 271/187; 271/195; 271/216; 271/315

[58] Field of Search ..... 271/315, 187, 271/195, 216

[56] References Cited

U.S. PATENT DOCUMENTS

| | | | |
|---|---|---|---|
| 4,537,390 | 8/1985 | Kiamco et al. | 271/315 |
| 4,834,361 | 5/1989 | Fenske et al. | 271/315 |
| 4,886,264 | 12/1989 | Haensch | 271/315 |
| 5,630,584 | 5/1997 | Seebet | 271/315 |

FOREIGN PATENT DOCUMENTS

| | | | |
|---|---|---|---|
| 4-80036 | 3/1992 | Japan . | |
| 4-96457 | 8/1992 | Japan . | |
| 405097310A | 4/1993 | Japan | 271/315 |
| 25480079 | 2/1995 | Japan . | |

*Primary Examiner*—H. Grant Skaggs
*Attorney, Agent, or Firm*—Ronlad P. Kananen; Rader, Fishman & Grauer

[57] ABSTRACT

A fold section feeding out apparatus of a folding unit for a rotary press is capable of preventing rebounding of a read end portion of a fold section to be caused upon transferring from a delivery fan to a conveyer. The fold section feeding out apparatus includes the delivery fan receiving fold sections cut and folded by a folding unit for feeding, and the conveyer receiving fold sections fed from the delivery fan and transporting the fold section in overlapped condition with shifted for a predetermined pitch. The fold section feeding out apparatus also includes at least one air ejecting means opening above the conveyer and ejecting a compressed air from a leading end side of the fold section at least toward a position in the vicinity of the rear end of the fold section for holding the rear end of the fold section transferred from the delivery fan to the conveyer as being lowered according to rotation of the delivery fan, for restricting free movement of the rear end of the fold section.

5 Claims, 5 Drawing Sheets

FOLD SECTION FEEDING OUT APPARATUS OF FOLDING UNIT

BACKGROUND OF THE INVENTION

1. Field of the Invention

The present invention relates to a fold section feeding out apparatus located below a delivery fan in a folding unit for a rotary press. More particularly, the invention relates to a fold section feeding out apparatus of a folding unit for a rotary press, which can prevent a rear end portion of a fold section ejected from the delivery fan from being turned over.

2. Description of the Related Art

A fold section feeding out apparatus of a folding unit for a rotary press as set forth above has been known as disclosed in Japanese Patent No. 2548079, for "Fold Section Feeding Out Apparatus of Folding Unit", for example. Also, mechanisms ejecting an air in the vicinity of a delivery fan have been known as disclosed in Japanese Unexamined Utility Model Publication No. Hei 4-96457 for "Ejection Device of Folding Machine for Rotary Press", Japanese Unexamined Patent Publication No. Hei 4-80036 for "Method and Apparatus for Preventing Electrostatic Sticking of Printing Paper", for example.

The fold section feeding out apparatus disclosed in the above-identified Japanese Patent No. 2548079 is a feeding out apparatus constructed with two conveyers cooperatively actuated for adjusting a distance between an outer periphery of the delivery fan and an upper surface of the conveyer, namely for adjusting a dropping distance so that the conveyer may not be excessively distant from the delivery fan, for avoiding jumping of the fold section in reaction to it dropping upon transfer to the upper surface of the conveyer when the fold section is transferred from the delivery fan.

On the other hand, the ejection device disclosed in Japanese Unexamined Utility Model Publication No. Hei 4-96457 takes a measure for drawback to be caused by static charge of the fold section in the delivery fan. A guide having an air blowing opening blowing an air between vanes at a position for receiving a fold section folded and fed from a folding machine by the delivery fan, is provided. Also, a stopper having an air blowing opening blowing an air onto a back surface of the delivery fan is provided. By blowing the air or ionized air from the blowing opening, the fold section is moved to a desired position against a force adhering the fold section onto the surface of the vane by static charge, or the fold section is prevented from adhering onto the surface of the vane by static charge and moved to the desired position.

Also, the apparatus disclosed in Japanese Unexamined Patent Publication No. Hei 4-80036 is constructed to prevent mutual electrostatic sticking of the fold section, by ejecting and spraying a sliding agent, such as that consisted of fine powder on the mutually mating surfaces of the fold sections, through a nozzle arranged in opposition to the delivery fan.

On the other hand, in the rotary press always driven at a high speed, for example, the rotary press having a normal printing speed of a hundred-thirty thousands copies or more per hour, when printing is performed at the normal printing speed, as shown in FIGS. 4 and 5 (these figures are similar to FIG. 1 while a delivery fan and a conveyer are omitted from illustration), when the fold section 74*b* or 74*t* drops onto the conveyer from the delivery fan, all of the rear end portions of the fold sections 74*b* or 74*t* are cut, and so-called leaf form rear end portions 36 are laid on the conveyer an cause significant rebound due to reaction of the impact.

Then, subsequent bag form fold section 73*b* or 73*t* may be stacked over the rebounded rear end portion to form turned over portion 33*b* or 33*t*.

Namely, as shown in FIG. 4, in case of the fold section where one of the side ends of the fold section 74*b* forms the bag form side end portion 34*b* and the other side end is cut to form the leaf form side end portion 35 (hereinafter referred to as "broad sheet"), the rear end portion 36 of the fold section drops from the delivery fan onto the conveyer with impact. Therefore, the leaf form side end portion 35 having a low stiffness may be rebounded to cause triangular turning back. Then, the subsequent broad sheet 73*b* stacks over the rebounded portion to form the rebounded triangular turned back portion 33*b*.

On the other hand, as shown in FIG. 5, for example, in case of the fold section 74*t* where the both side portions are cut to form the leaf form side end portion 34*t* and 35 and to form the bag form only at the tip end (hereinafter referred to as "Tabloid sheet"), the rear end portion 36 of the Tabloid sheet 74*t* which has a low stiffness over the entire portion, drops from the delivery fan onto the conveyer with impact to cause rebounding at the entire rear end portion 36. Then, the subsequent Tabloid sheet 73*t* is stacked over the rebounded portion to form a parallel strip form turned over portion 33*t*.

The higher the normal printing speed of the rotary press, the higher the possibility of formation of the triangular turned over portion 33*b* or the parallel strip form turned over portion 33*t* becomes. And also the greater the number of pages of the fold section, the higher the possibility of formation of the triangular turned over portion 33*b* or the parallel strip from turned over portion 33*t* becomes. Occurrence of such turned over portions inherently interfere with operation of the apparatus in the downstream side process. In conjunction therewith, presence of such turned over portions should degrade commercial value and can be a hazard for a high speed printing of the rotary press.

In contrast with this, the fold section feeding out apparatus as disclosed in the above-identified Japanese Patent No. 2548079, permits adjustment of appropriate drop speed so as not to cause rebounding of the fold section by reaction upon dropping of the fold section from the delivery fan onto the conveyer by moving the transporting apparatus constituted of cooperatively operating two conveyers to prevent rebounding of the rear end portion of the fold section.

However, the drop distance has to be adjusted every time the number of pages of the fold section is varied. Furthermore, the distance has to be adjusted frequently depending upon the printing speed during printing. Constantly maintaining the fold section having no turned over portion requires skill of the operator in operation, and further requires substantial work load in operation. In addition, the feeding out apparatus as disclosed is constructed with a large number of parts to be expensive and troublesome in maintenance.

On the other hand, the ejection device as disclosed in the above-identified Japanese Unexamined Utility Model Publication No. Hei 4-96457, is provided with the air blowing opening in the guide guiding the fold section to the delivery fan, and is also provided with the air blowing opening in the stopper which pushes the fold section from the delivery fan onto the conveyer, for blowing the air or ionized air to move the fold section to the desired position against adhering force due to static charge or to extinguish the adhering force due to static charge by removing the static charge and to move the fold section to the desired position. However, the disclosed ejection device is not effective for preventing turning over the fold section.

Furthermore, in the above-identified Japanese Unexamined Patent Publication No. Hei 4-80036, there is provided a nozzle ejecting fine powder in opposition to the delivery fan for ejecting and spraying the fine powder on the mutually stacked surface of the fold sections in order to prevent electrostatic sticking or adhesion of the fold sections with each other. However, it is not possible to prevent the fold section from causing turning over.

In addition, a large fraction of the ejected and sprayed powder fly off the environment and is accumulated. Therefore, frequent cleaning becomes necessary. Furthermore, the flying powder should degrade work environment. Also, the powder may penetrate into the mechanical parts and cause shortening of the life of the machine. Furthermore, the powder deposited on the fold section contaminates the apparatus in the downstream process and inherently gives the printing paper surface a harsh feel.

SUMMARY OF THE INVENTION

The present invention addresses all of the problems in the prior art set forth above. Therefore, it is an object of the present invention to provide a fold section feeding out apparatus of a folding unit for a rotary press which can eliminate turning over and disturbance of rear end portions of the fold section by preventing rebounding of the rear end portions of the fold sections to be caused by reaction against falling down or dropping upon transfer from a delivery fan to a conveyer, can avoid necessity of adjusting operation of drop distance of the fold section from the delivery fan onto the conveyer adapting to number of pages of the fold section and/or a printing speed to require lesser skill of operator and can be simple and inexpensive in construction to reduce possibility of occurrence of failure and to facilitate maintenance.

According to the first aspect of the present invention, a fold section feeding out apparatus of a folding unit for a rotary press comprises:

a delivery fan receiving fold sections cut and folded by a folding unit for feeding;

a conveyer receiving fold sections fed from the delivery fan and transporting the fold section in overlapped condition with shifted for a predetermined pitch; and at least one air ejecting means opening above the conveyer and ejecting a compressed air from a leading end side of the fold section at least toward a position in the vicinity of the rear end of the fold section for holding the rear end of the fold section transferred from the delivery fan to the conveyer as being lowered according to the rotation of the delivery fan, for restricting free movement of the rear end of the fold section.

According to the second aspect of the present invention, a fold section feeding out apparatus of a folding unit for a rotary press comprises:

a delivery fan receiving fold sections cut and folded by a folding unit for feeding;

a conveyer receiving fold sections fed from the delivery fan and transporting the fold section in overlapped condition with shifted for a predetermined pitch;

a rear end guide extended in the vicinity of a rotating region and substantially along an outer periphery of the rotating region, in which the delivery fan rotates from a folding unit side to an upper side of the conveyer;

at least one air ejecting means opening above the conveyer and ejecting a compressed air from a leading end side of the fold section at least toward a position in the vicinity of the rear end of the fold section.

In the preferred construction, the fold section feeding out apparatus may further comprise side end guide located in the vicinity of the side end of the fold section lowered according to the rotation of the delivery fan and transferred from the delivery fan to the conveyer, and air ejection means provided in the side end guide.

The rear end guide may be divided in as guiding direction of the rear end of the fold section, and a part of the rear end guide is movable in a direction away from the rotating region of the delivery fan.

The fold sections cut and folded by the folding unit are transferred to the conveyer according to the rotation of the delivery fan and transported in overlapped with a shift for a predetermined pitch. At this time, the rear end of each fold sections dropped onto the conveyer is constrained to prevent turning over to be caused at this portion.

On the other hand, the fold section dropped onto the conveyer according to the rotation of the delivery fan is guided the rear end portion by the rear end guide on both transverse sides, until reaching to the conveyer to absorb shock upon dropping of the rear end portion of the fold section onto the conveyer. Thus, rebounding of the rear end portion reactive against dropping becomes small or little. Furthermore, by providing the air ejecting means in the side end guide, the compressed air can be certainly ejected toward the corner portion of the rear end of the fold section which is the most likely portion to cause rebounding to certainly present turning over to be caused to this portion. On the other hand, when jamming of the fold sections is caused, the jammed fold sections can be removed by moving a part of the rear end guide.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
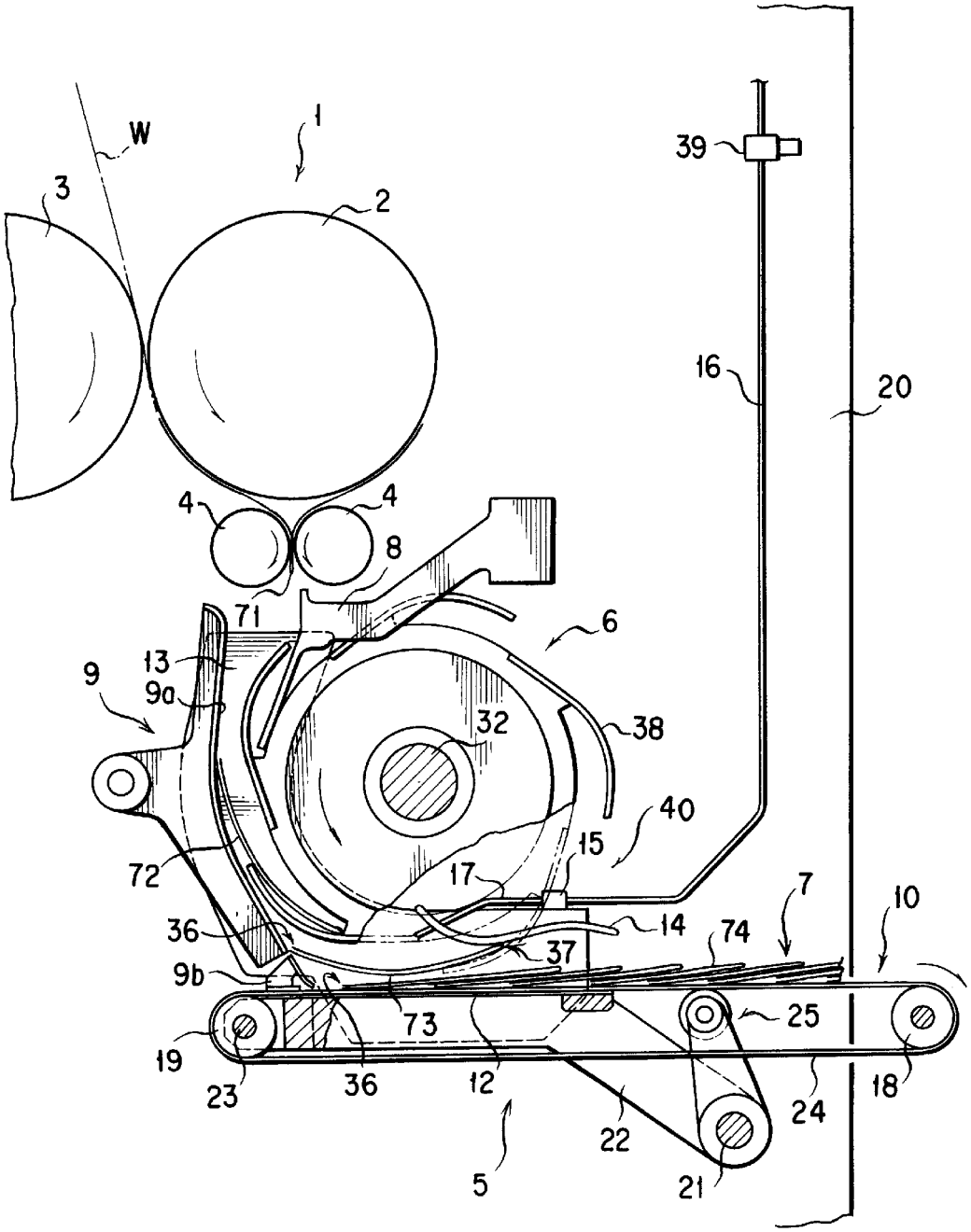
FIG. 1 is a side view of the preferred embodiment of a fold section feeding out apparatus of a folding unit for a rotary press according to the present invention.
Figure 2:
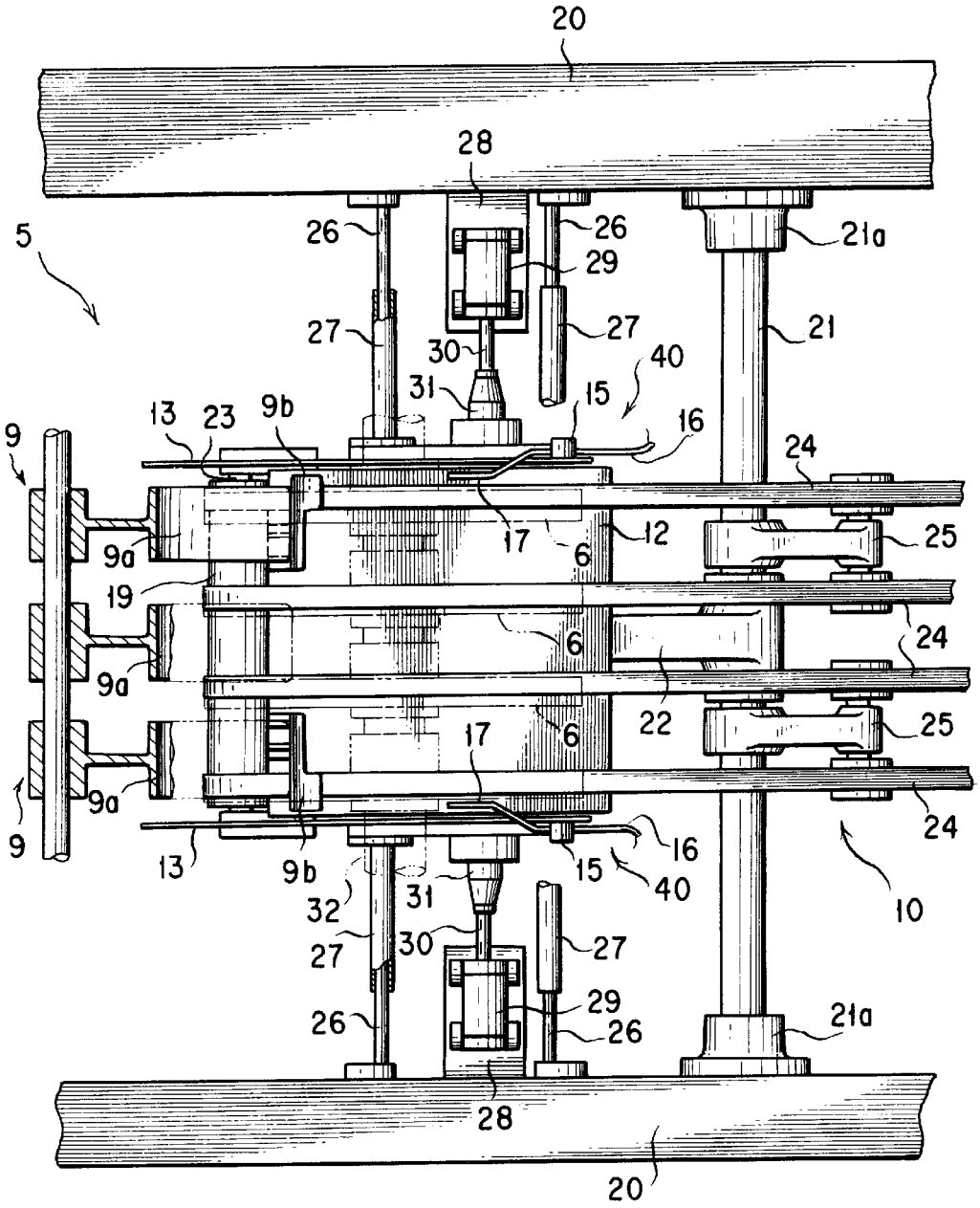
FIG. 2 is a plan view of the preferred embodiment of a fold section feeding out apparatus of a folding unit for a rotary press according to the present invention.
Figure 3:
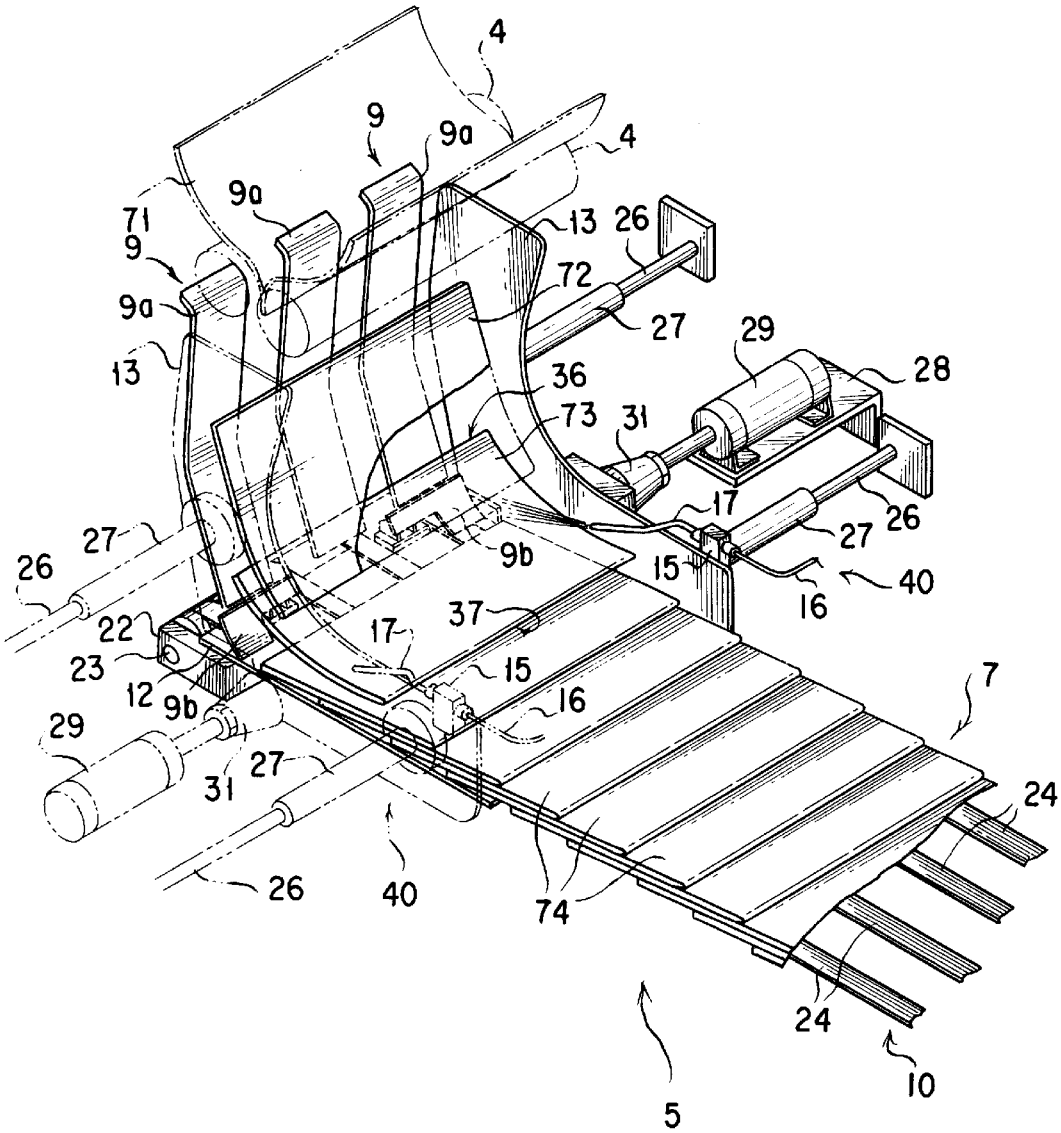
FIG. 3 is a perspective view of the preferred embodiment of a fold section feeding out apparatus of a folding unit for a rotary press according to the present invention.
Figure 4:
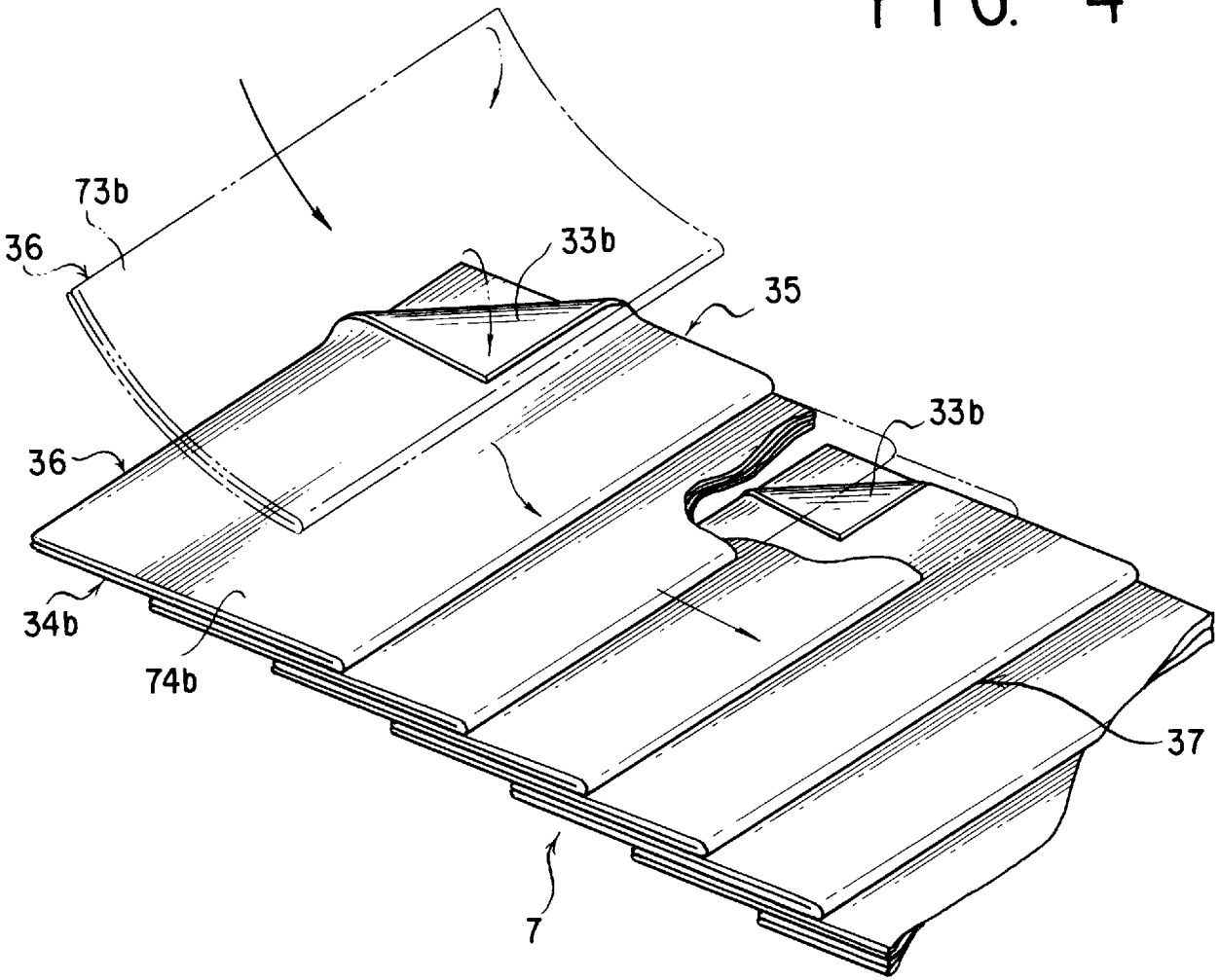
FIG. 4 is an explanatory illustration of triangular turning over of a fold section.
Figure 5:
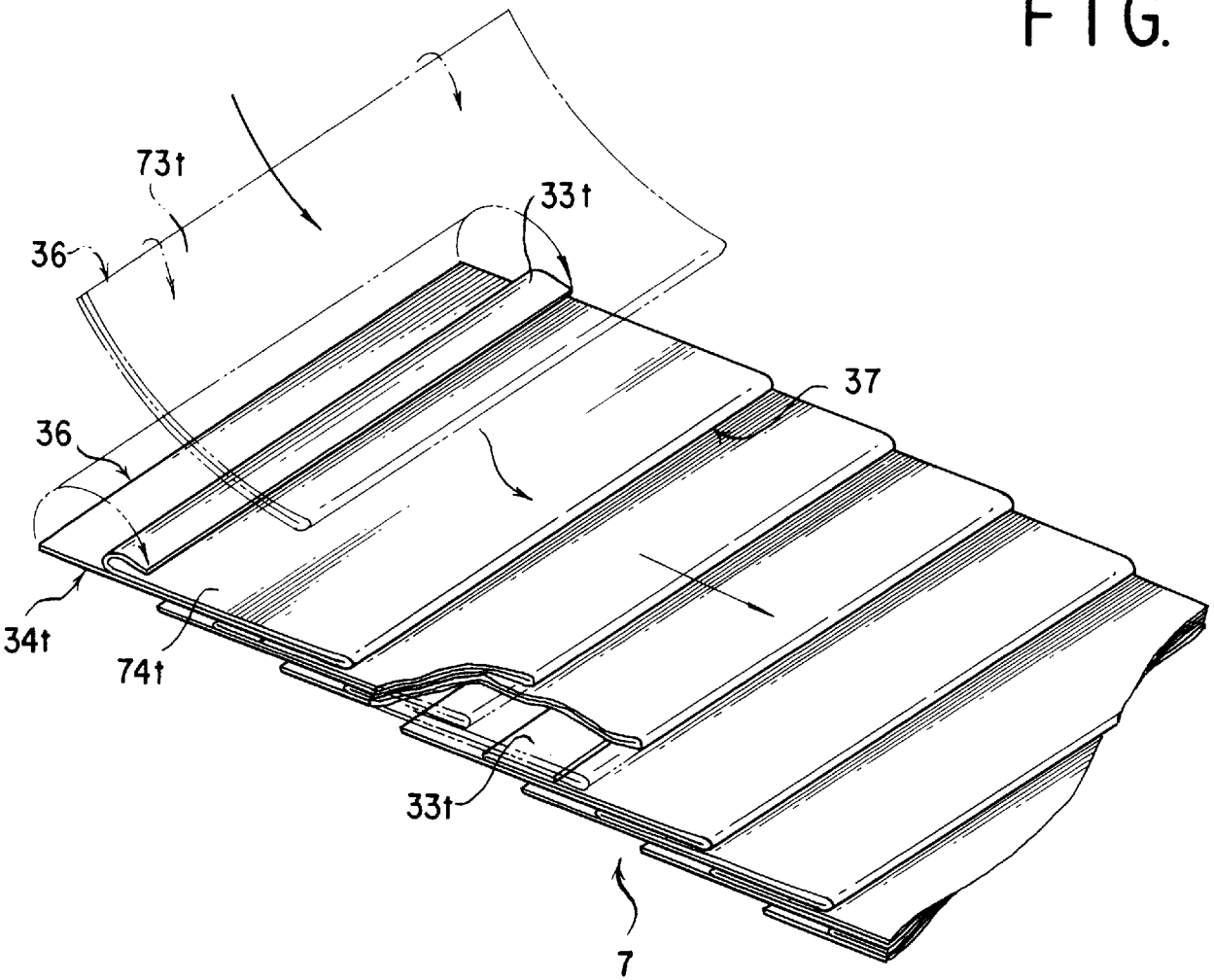
FIG. 5 is an explanatory illustration of a parallel strip form turning over of the fold section.

FIG. 1 is a side view of the preferred embodiment of a fold section feeding out apparatus of a folding unit for a rotary press according to the present invention, FIG. 2 is a plan view of the preferred embodiment of a fold section feeding out apparatus of a folding unit for a rotary press according to the present invention, FIG. 3 is a perspective view of the preferred embodiment of a fold section feeding out apparatus of a folding unit for a rotary press according to the present invention, FIG. 4 is an explanatory illustration of triangular turning over of a fold section, and FIG. 5 is an explanatory illustration of a parallel strip form turning over of the fold section.

In FIG. 1, a folding unit 1 is constructed with a pair of folding cylinder 2 and a serrated cylinder 3 cutting a printing web W and folding the cut web, a pair of pressure rollers 4 for pressing a fold section 71 cut and folded by the folding cylinder 2 and the serrated cylinder 3, and so forth.

In the preferred embodiment of the present invention, a construction of a fold section feeding out apparatus 5 is constructed with a delivery fan 6 fixed on a shaft 32 located below the pressure rollers 4 and rotatably driven in a counterclockwise direction in the drawing by a not shown driving means, a fold section introducing guide 8 guiding the fold section 71 ejected and dropped from the pressure rollers 4 into the delivery fan 6, and rear end guides 9 located with a proper distance from a rotating region of a tip end of vanes 38 forming the delivery fan 6 and shaped to extend from the lower side of the pressure roller 4 to an upper surface of a conveyer 10.

While the rear end guides 9 may be integrally constructed into a shape extending from a portion mating with the pressure rollers 4 to reach the upper surface of the conveyer 10, the shown embodiment takes a construction, in which the rear end guides 9 are divided into dropping direction guide members 9*a* extending from an end mating with the pressure rollers 4 and an end located in the vicinity of the conveyer 10 and auxiliary guide members 9*b* continuous with the dropping direction guide members 9*a*. The dropping direction guide members 9*a* are movable in the left and right direction in FIG. 1 for moving between a guiding position for guiding the rear end of the fold section and a position with increased distance from the tip end of the vanes 38 of the delivery fan 6 for resolving jamming, to vary a distance to the tip ends of the vane 38 of the delivery fan 6.

The auxiliary guide members 9*b* are formed into shapes extending inwardly from the end portion of the conveyer 10 and are mounted on a receptacle plate 12.

On both sides in the axial direction of the delivery fan 6, a pair of side end guides 13 is provided for introducing with restricting side ends of the fold section 72. At the proper position below the delivery fan 6, the conveyer 10 is provided for transporting the sequence of fold sections out of the apparatus. Also, a front end guide 14 is provided for blocking the fold section 73 transported from the upstream side by rotation of the delivery fan 6 and transferred to the conveyer 10. The upper surface of the conveyer 10 is set at a proper distance with respect to the lower surface of rotating region of the delivery fan 6 to make subsequent adjustment unnecessary.

Air ejection means 40 is constructed with piping blocks 15 mounted on the front end guides 13, nozzles 17 mounted on one end of the piping blocks 15 and electromagnetic valves 39 (one of the electromagnetic valves 39 for ejecting the compressed air is not shown) for ejection of compressed air which are connected to the other ends of the piping blocks 15 via pipes 16 feeding a compressed air and also connected to a not shown compressed air source. Then, the nozzles 17 are provided with an opening toward the lower side of the shaft 32 of the delivery fan 6 for ejecting compressed air at a proper strength from the leading side of the fold section 73 toward a position in the vicinity of the rear end portion 36.

A roller 18 on the downstream side of the conveyer 10 is rotatably mounted on frames 20 of the folding unit by not shown support members. On the other hand, a roller 19 on the upstream side located below the rear end guide 9 is rotatably assembled via a stay 21 (see FIG. 2) supported on brackets 21*a* fixed on the frames 20, a conveyer frame 22 mounted on the stay 21 and a shaft 23 assembled to the conveyer frame 22. Over these rollers 18 and 19, a plurality of endless belts 24 are wound. In the vicinity of the back surfaces of the endless belts 24, the receptacle plate 12 supporting deflection of the belts is fixed on the conveyer frame 22. Also, belt receiving members 25 are mounted on the stay 21.

The endless belts 24 are rotatingly driven in a clockwise direction in FIG. 1 by the roller 18 of the conveyer 10 driven by not shown driving means. A peripheral speed of the endless belts 24 is set at a proper relationship with an angular velocity of the delivery fan 6 to maintain the overlapping pitch of the fold section series 7.

In FIG. 2, a pair of side end guides 13 are supported by guide members 27 inserted into guide shafts 26 fixed on the frames 20. Also, tip ends of expansion rods 30 of fluid pressure cylinders 29 mounted on brackets 28 respectively fixed on the frames 20 are connected to the side end guides 13 via link members 31 so as to move the side end guides 13 arranged in opposition toward and away from each other.

Next, operation will be discussed using FIG. 3 and with reference to FIGS. 1 and 2. A series of printing web W supplied from a printing unit (not shown) of a rotary press (for example, newspaper press) is cut and folded by the folding unit 1 to be fold sections 71 and transferred to the delivery fan 6, sequentially. The fold sections 72 transferred to the delivery fan 6 are transported downwardly by the delivery fan 6 rotating in a counterclockwise direction in FIG. 1. Since the delivery fans 6 continues rotation, the tip end portion 37 of the fold section 73 is blocked by the front end guide 14 to fall down onto the conveyer 10 sequentially. Fallen down fold sections 74 overlap at a proper pitch on the conveyer 10 to be transported out of the apparatus as a fold section series 7.

At this time, the rear ends of the fold sections 72 are guided by the dropping direction guide members 9*a* and the auxiliary guide members 9*b* forming the rear end guides 9.

Accordingly, shock upon dropping the rear end portion 36 of the fold section on the conveyer 10 becomes small, to thereby restrict the rebounding of the rear end 36 due to a reactive force.

When the rotary press reaches a predetermined printing speed, e.g. a printing speed of thirty thousands copies per hour, after initiation of print, the electromagnetic valve for not shown fluid pressure cylinder is actuated (turned ON) to frontwards drive the expansion rods 30 of the fluid pressure cylinders 29. Then, a pair of side end guides 13 supported on the guide members 27 movably inserted into the guide shafts 26, in opposition to each other, are moved frontwards in a direction to approach with each other for setting at proper positions with respect to the width of the fold section.

On the other hand, adapting to operation of the electromagnetic valve for the not shown fluid pressure cylinder, the electromagnetic valve 39 for ejection of the compressed air forming the air ejection means 40 are actuated (turned ON) to continuously eject the proper strength of compressed air toward the rear end portion 36 of the fold section 73 from the nozzles 17. Rebounding of the rear ends of the fold sections 73 is suppressed by the proper strength of air flow by ejection of the compressed air, or, in the alternative, rebounding may be quickly stabilized to the original position. Accordingly, even when the subsequent fold section drops onto the rear end of the preceding fold section, turning over of the rear end of the fold section 73 is not caused.

Namely, by ejection of the compressed air by the air ejection means 40, rebounding of the fold section dropping from the delivery fan 6 to the upper surface of the conveyer can be suppressed, or even when rebounding is caused slightly, the rebounding can be quickly stabilized to the original position. Therefore, without adjustment of the dropping distance of the fold section by vertically moving the conveyer 10, turning over or disturbance due to rebounding of the rear end portion 36 of the fold section 74 dropped from the delivery fan 6 to the conveyer 10 can be prevented.

On the other hand, when the printing speed of the rotary pressure drops to stop printing, and the printing speed is reached down to the predetermined printing speed, operation of respective electromagnetic valves are terminated (turned OFF) to retract the expansion rods 30 of the fluid pressure cylinders 29 to backwardly move a pair of side end guides 13. In conjunction therewith, the air ejection means 40 stops ejection of the compressed air from the nozzles 17.

When jamming of the fold sections is caused in the fold section feeding out apparatus 5, the dropping direction guide members 9*a* of the rear end guides 9 are moved away from the delivery fan 6 for removing the jamming fold sections.

In the embodiment set forth above, while a pair of nozzles 17 are provided, sufficient effect can be achieved by actuating at least one nozzle 17 on one side on the side corresponding to rebounding of the triangular portion among a pair of nozzles 17 of the air ejection means 40, in case of broad sheet 74*b*, by actuating both of a pair of nozzles 17 of the air ejection means 40 in case of Tabloid sheet.

Also, in the shown embodiment, the electromagnetic valves 39 for ejection of the compressed air are provided corresponding to the respective plurality of nozzles 17 and individually actuate respective electromagnetic valves 39 for ejection of the compressed air to vary the compressed air ejecting condition adapting to the kind of the fold section (broad sheet, Tabloid sheet and so forth). However, when the ejecting condition of the compressed air is not varied for adapting to the kind of the fold section, it is possible to take a construction, in which the air ejecting means (not shown) is provided with only one electromagnetic valve for ejecting the compressed air for simultaneously ejecting the compressed air through a plurality of nozzles.

Although the present invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A fold section feeding out apparatus of a folding unit for a rotary press comprising:

a delivery fan receiving fold sections cut and folded by a folding unit for feeding;

a conveyer receiving fold sections fed from said delivery fan and transporting said fold section in overlapped condition with shifting for a predetermined pitch; and at least one air ejecting means opening above said conveyer and ejecting a compressed air from a leading end side of the fold section at least toward a position in the vicinity of the rear end of the fold section for holding the rear end of said fold section transferred from said delivery fan to said conveyer as said fold section is being lowered according to rotation of said delivery fan, for restricting free movement of the rear end of said fold section.

2. A fold section feeding out apparatus of a folding unit for a rotary press as set forth in claim 1, which further comprises at least one side end guide located in the vicinity of at least one side end of the fold section lowered according to rotation of said delivery fan and transferred from said delivery fan to said conveyer, and said air ejection means provided in said at least one side end guide.

3. A fold section feeding out apparatus of a folding unit for a rotary press comprising:

a delivery fan receiving fold sections cut and folded by a folding unit for feeding;

a conveyer receiving fold sections fed from said delivery fan and transporting said fold section in overlapped condition with shifting for a predetermined pitch;

a rear end guide extended in the vicinity of a rotating region and substantially along an outer periphery of said rotating region, in which said delivery fan rotates from a folding unit side to an upper side of said conveyer;

at least one air ejecting means opening above said conveyer and ejecting a compressed air from a leading end side of the fold section at least toward a position in the vicinity of the rear end of the fold section for holding the rear end of said fold section transferred from said delivery fan to said conveyer as said fold section is being lowered according to rotation of said delivery fan, for restricting free movement of the rear end of said fold section.

4. A fold section feeding out apparatus of a folding unit for a rotary press as set forth in claim 3, which further comprises at least one side end guide located in the vicinity of at least one side end of the fold section lowered according to rotation of said delivery fan and transferred from said delivery fan to said conveyer, and said air ejection means provided in said at least one side end guide.

5. A fold section feeding out apparatus of a folding unit for a rotary press as set forth in claim 3, wherein said rear end guide is divided in a guiding direction of said rear end of said fold section, and a part of said rear end guide is movable in a direction away from said rotating region of said delivery fan.

* * * * *